US011519582B2

(12) United States Patent
Chen

(10) Patent No.: US 11,519,582 B2
(45) Date of Patent: Dec. 6, 2022

(54) HIGH EFFICIENCY VEHICLE BACKUP LAMPS

(71) Applicant: Ford Global Technologies, LLC, Dearborn, MI (US)

(72) Inventor: Linsheng Chen, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/224,228

(22) Filed: Apr. 7, 2021

(65) Prior Publication Data

US 2022/0325867 A1 Oct. 13, 2022

(51) Int. Cl.

| | |
|---|---|
| ***F21S 43/20*** | (2018.01) |
| ***F21V 5/04*** | (2006.01) |
| ***F21S 43/31*** | (2018.01) |
| ***F21S 43/14*** | (2018.01) |
| *F21W 103/45* | (2018.01) |

(52) U.S. Cl.

CPC ..... *F21S 43/26* (2018.01); *F21S 43/14* (2018.01); *F21S 43/31* (2018.01); *F21V 5/043* (2013.01); *F21W 2103/45* (2018.01)

(58) Field of Classification Search

CPC . F21S 43/26; F21S 43/14; F21S 43/31; F21V 5/043; F21W 2103/45

See application file for complete search history.

(56) References Cited

U.S. PATENT DOCUMENTS

| | | | | |
|---|---|---|---|---|
| 6,414,801 | B1 * | 7/2002 | Roller | B60Q 1/0052 362/240 |
| 7,686,481 | B1 * | 3/2010 | Condon | F21S 43/14 362/333 |
| 9,709,727 | B2 | 7/2017 | Goto et al. | |
| 9,994,143 | B2 | 6/2018 | Ferigo et al. | |

(Continued)

FOREIGN PATENT DOCUMENTS

| | | | | |
|---|---|---|---|---|
| JP | 2009157029 | A * | 7/2009 | |
| WO | WO-9900623 | A1 * | 1/1999 | F21S 41/28 |

OTHER PUBLICATIONS

Hella Headlamp Systems, "Ellipsoidal (DE)", dastem.torque.net/techdocs/Archives/Hella_Systems/de.htm, Feb. 2, 2021, 2 pages.

(Continued)

*Primary Examiner* — Elmito Breval
*Assistant Examiner* — Glenn D Zimmerman
(74) *Attorney, Agent, or Firm* — Frank Lollo; Eversheds Sutherland (US) LLP

(57) ABSTRACT

A backup light apparatus provides a somewhat uniform distribution of light intensity in an area within the view of a backup camera of a vehicle. The backup light apparatus may satisfy various governmental and manufacturer safety rules. The backup light apparatus has a pillow lens array, a first collimator, a prism lens array, and a second collimator. The first collimator directs light in the direction of its optical axis to the pillow lens array. The second collimator directs light in the direction of its optical axis to the prism lens array. The pillow lens array has an array of pillow lenses facing away (Continued)

from the first collimator. The prism lens array has an array of prism lenses facing away from the second collimator. The prism lenses direct light at varying angles relative to the optical axis of the second collimator.

19 Claims, 10 Drawing Sheets

(56) References Cited

U.S. PATENT DOCUMENTS

| | | | | |
|---|---|---|---|---|
| 10,451,243 | B2 | 10/2019 | Gloss et al. | |
| 2012/0033441 | A1* | 2/2012 | Sousek | F21S 43/14 362/555 |
| 2015/0252984 | A1* | 9/2015 | Van Bommel | F21V 9/32 362/84 |
| 2016/0311363 | A1* | 10/2016 | Ferigo | F21S 43/26 |
| 2017/0238277 | A1* | 8/2017 | Irgang | B60Q 1/0094 362/516 |
| 2019/0162380 | A1 | 5/2019 | Garin et al. | |
| 2021/0054987 | A1* | 2/2021 | Chen | F21V 5/045 |

OTHER PUBLICATIONS

Hella Headlamp Systems, "Super DE (Combined with FF)", dastem.torque.net/techdocs/Archives/Hella_Systems/syper_de.htm, Feb. 2, 2021, 2 pages.

* cited by examiner

100

102

Prism Profiles

HIGH EFFICIENCY VEHICLE BACKUP LAMPS

BACKGROUND

Reverse cameras are becoming more common on vehicles. Reverse cameras provide video to a display convenient to a vehicle operator and allow the operator to see what is behind the vehicle when backing the vehicle. In low-light conditions such as at night, the area behind a vehicle may need to be illuminated to allow the reverse camera to capture video data of sufficient quality for the operator to perceive conditions behind the backing vehicle. In fact, there are legal and vehicle-manufacturer rules specifying requirements for such illumination. U.S. Federal Motor Vehicle Safety Standard (FMVSS) rules 108 and 111 are two such rules. Backup illumination rules specify the location and extent of the ground area to be illuminated as well as the brightness of the illumination within that area. These requirements can be demanding. FIG. 1 shows illumination patterns typical of previous backup lamps (the backup lamp being on the left of the patterns). As seen in the upper pattern 100, some previous illumination patterns have irregularities such as hot spots and dead spots; illumination is not uniform within the desired area of illumination. As seen in the lower pattern 102, other backup lights may have significant spillover of light beyond the desired area of illumination. Such spillover is inefficient in that power is wasted and components of the backup light may be more expensive than necessary.

Designs for efficient backup lights with somewhat uniform light distributions are discussed below.

BRIEF DESCRIPTION OF THE DRAWINGS

The present description will be better understood from the following detailed description read in light of the accompanying drawings, wherein like reference numerals are used to designate like parts in the accompanying description.

DETAILED DESCRIPTION

Overview

The following overview is included only to introduce some concepts discussed in the Detailed Description below. This overview is not comprehensive and does not delineate the scope of the claimed subject matter.

A backup light apparatus provides a somewhat uniform distribution of light intensity in an area within the view of a backup camera of a vehicle. The backup light apparatus may satisfy various governmental and manufacturer safety rules. The backup light apparatus has a pillow lens array, a first collimator, a prism lens array and pillow lens array combination, and a second collimator. The first collimator directs light in the direction of its optical axis to the pillow lens array. The second collimator directs light in the direction of its optical axis to the prism lens array and pillow lens array combination. The pillow lens array has an array of pillow lenses facing away from the first collimator. The prism lens array and pillow lens array combination has an array of prism lenses facing away from the second collimator. The prism lenses and pillow lens array combination direct light at varying angles relative to the optical axis of the second collimator.

Many of the attendant features will be explained below with reference to the following detailed description considered in connection with the accompanying drawings.

Illustrative Embodiments

Figure 1:
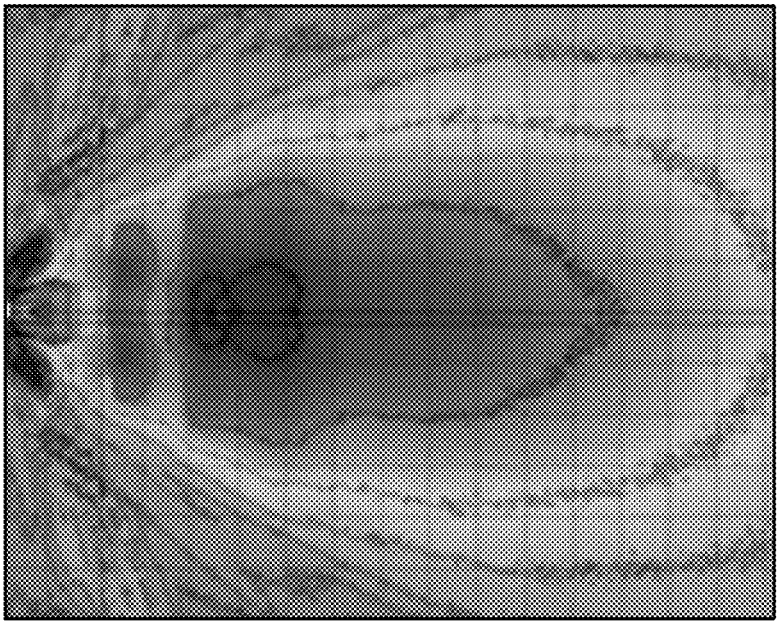
FIG. 1 (Prior Art)
FIG. 1 shows illumination patterns typical of previous backup lights.
Figure 1:
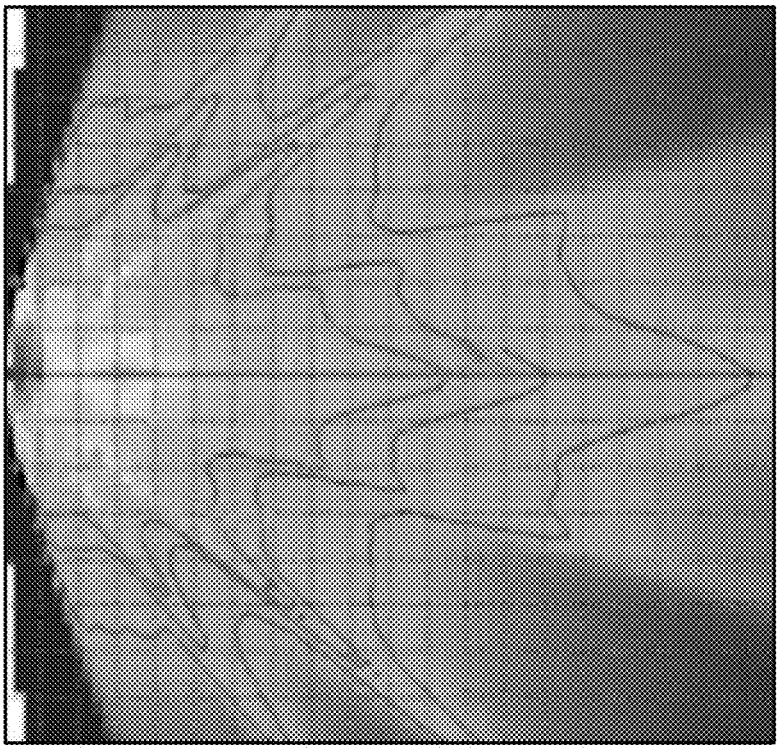
FIG. 1 (Prior Art)
Figure 2:
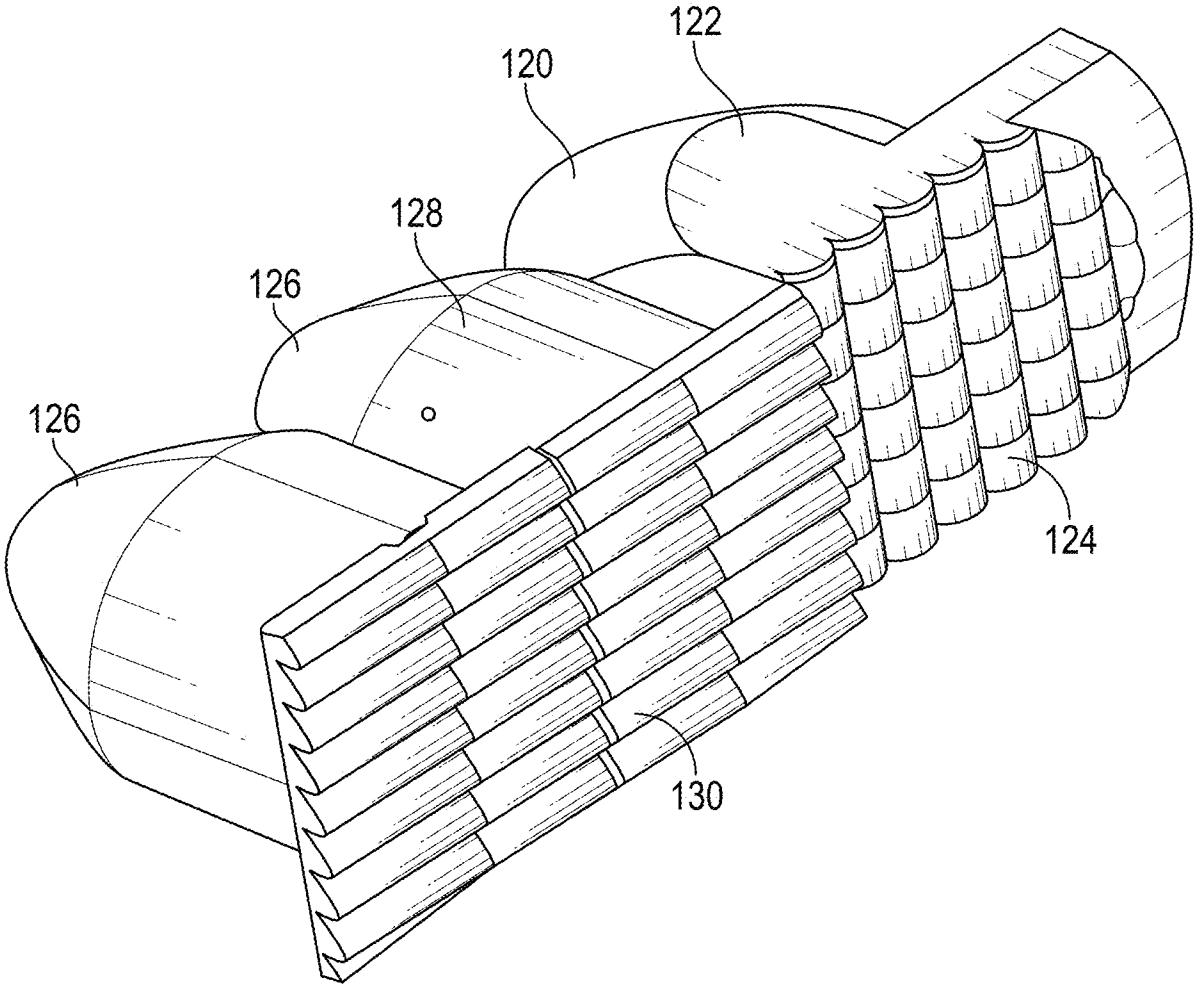
FIG. 2 shows a backup light in accordance with one or more embodiments of the disclosure.

FIG. 2 shows a backup light that is efficient and provides somewhat uniform illumination within the view of a reverse camera. The example design in FIG. 2 includes three individual lights, however, because the two lights on the left have the same components only one of those lights will be described. In some instances, the two lights on the left can include similar but not identical components (e.g., they can have different spread angles to improve uniformity on the ground or send some light to meet backup lamp legal requirement and improve photometric margin). The third light (far left) may or may not be necessary, depending on implementation details and performance requirements.

The light on the right side of FIG. 2 includes a first collimator 120, an optical extension 122, and a pillow lens array 124. A first lamp (not shown) such as a light emitting diode (LED) emits light into or within the first collimator 120. The first collimator 120 may be a reflector, lens, or combination thereof. The first collimator 120 reflects/refracts the light from the first lamp through a first optical extension 122 to the pillow lens array 124. The first optical extension 122 may not be necessary. Without affecting performance of the reverse light, the length of the first optical extension 122 can be varied to accommodate various vehicle designs. The first optical extension 122 may be a reflective tube, a cylinder of optical fibers, or the like. The light from the first collimator 120 emits enters the front-facing surface of the pillow lens array 124, is refracted while passing through the pillow lens array 124, and is emitted from the rear-facing surface of the pillow lens array 124 and falls upon the ground behind the vehicle that is within view of the reverse camera.

As shown in FIG. 2, the pillow lens array 124 has multiple convex pillow lenses. In one embodiment, the pillow lenses are columnar convex lenses arranged side by side. The pillow lenses may also be vertically offset from one another, arranged in different patterns and so forth. Depending on implementation, the pillow lens array 124 alone may be sufficient to meet the requirements of FMVSS rule 108. The pillow lenses may be torus or pillow lenses, for example. In some embodiments, the light from an LED is collimated and then strikes the torus lenses or pillow lenses. In some embodiments, light may be distributed 48 degrees left and right, 10 degrees up, and 5 degrees down.

In FIG. 2, a prism array and pillow lens array combination light is disposed next to the pillow array light includes a second lamp (shown in FIG. 3), a second collimator 126, a second optical extension 128, and a prism lens array 130. The second lamp emits light into or within the second collimator 126. As with the first collimator 120, the second collimator 126 may be a reflector, lens, or combination thereof. The second collimator 126 reflects/refracts the light from the second lamp through a second optical extension 122 to the prism lens array and pillow lens array combination 130. The second optical extension 128 is also an optional component whose length can be varied to accommodate the form of the vehicle in which the backup light is used.

Figure 3:
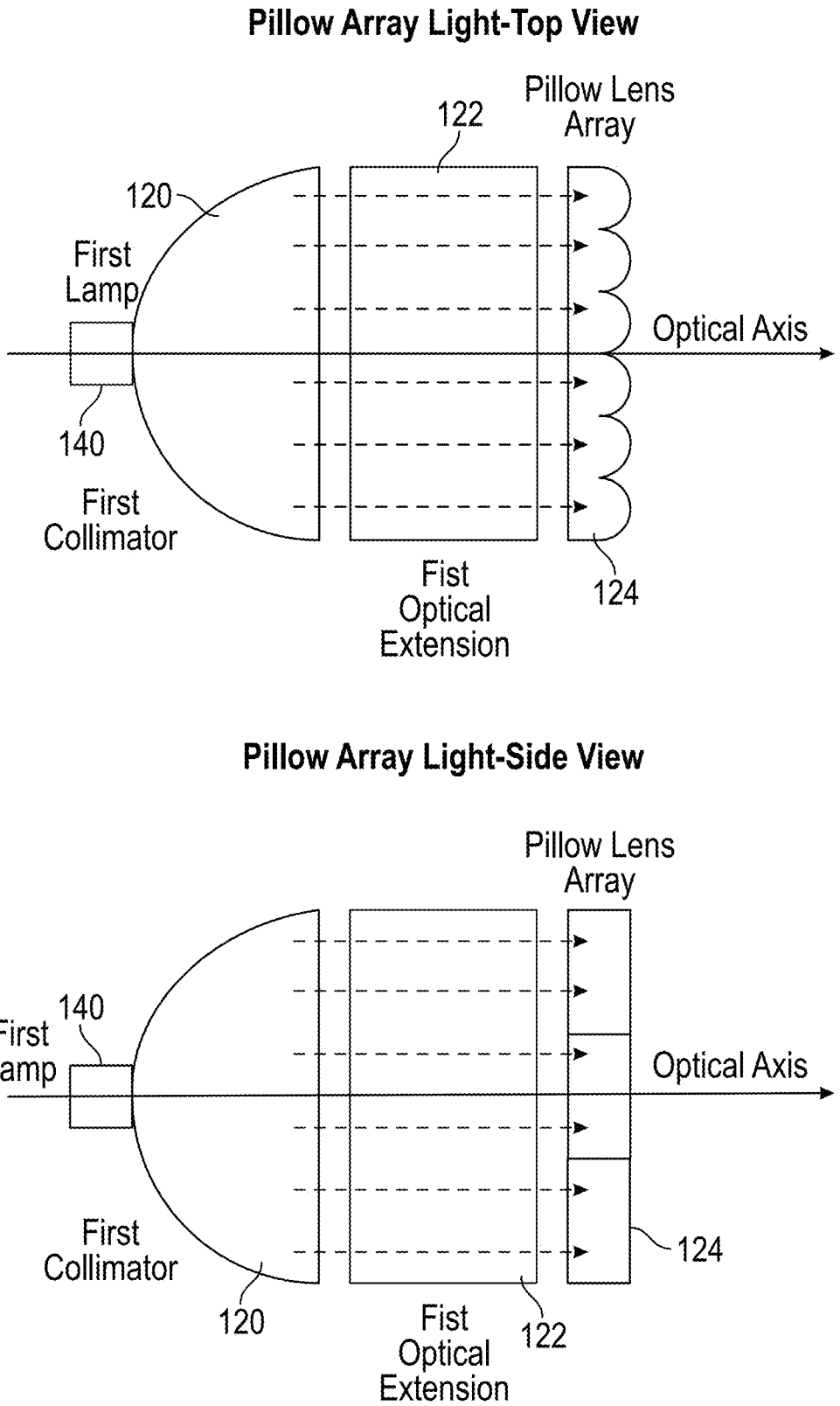
FIG. 3 shows a top view and a side view of a pillow array light in accordance with one or more embodiments of the disclosure.

FIG. 3 shows a top view and a side view of the pillow array light. The first lamp 140 provides light to the first collimator 120. In the embodiment shown in FIG. 3, the first collimator 120 may be a total internal reflector, as discussed below with reference to FIG. 4B. The collimated light passes through the first optical extension 122 and into the pillow lens array 124. The light is refracted to the area of desired illumination.

Figure 4A:
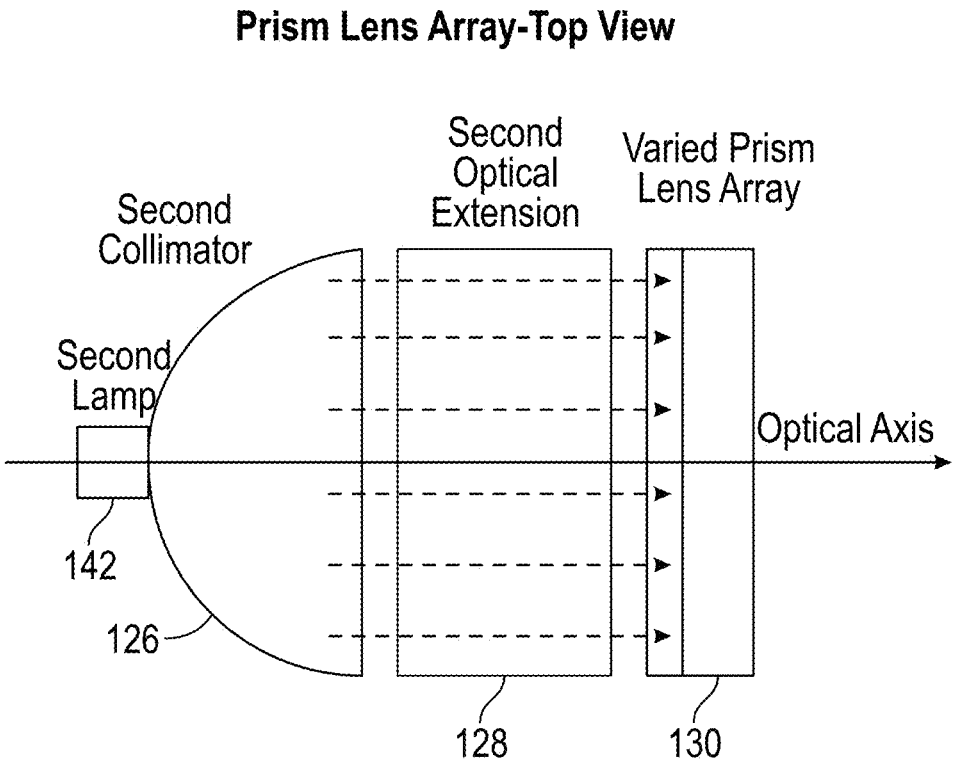
FIG. 4A shows a top view and a side view of a prism array light in accordance with one or more embodiments of the disclosure.
Figure 4A:
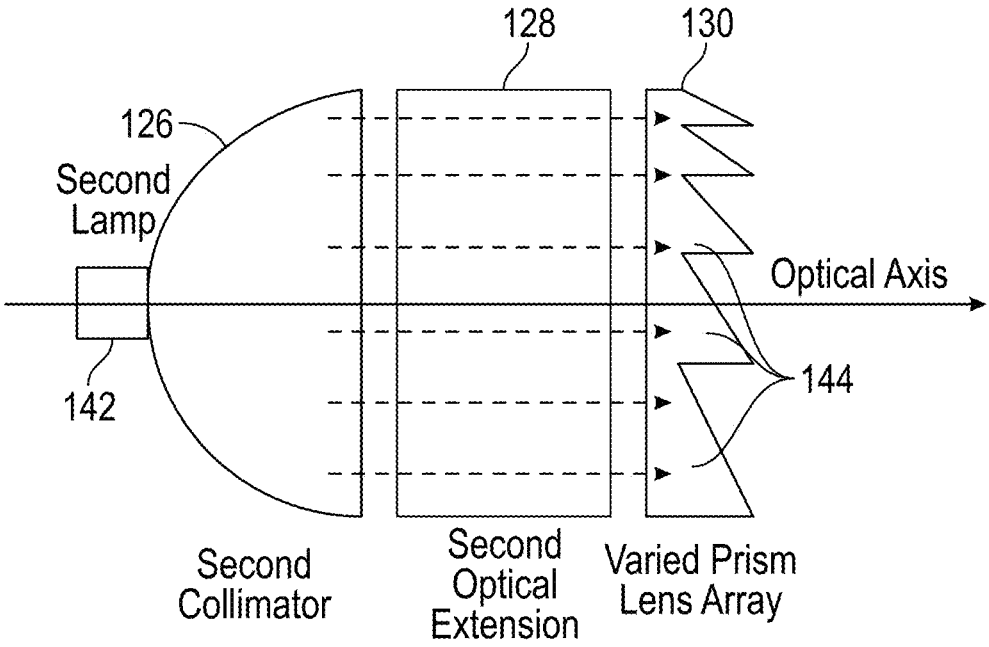

FIG. 4A shows a top view and a side view of the prism array light. In the embodiment shown in FIG. 4A, the second lamp 142 emits light that is collimated by the second collimator 126. In the embodiment shown in FIG. 4A the collimator is a reflector with parabolic or spherical conic sections, for instance, although any shape that collimates the light from the second lamp 142 will suffice. After passing through the optional second optical extension 128, the collimated lights passes through the prisms 144 of the varied prism lens array 130. As discussed next with reference to FIGS. 5 and 6, angles and surfaces of the prisms 144 are varied to increase the uniformity of the intensity-distribution of light emitted by the prism lens array 130 onto the desired area of illumination.

Figure 4B:
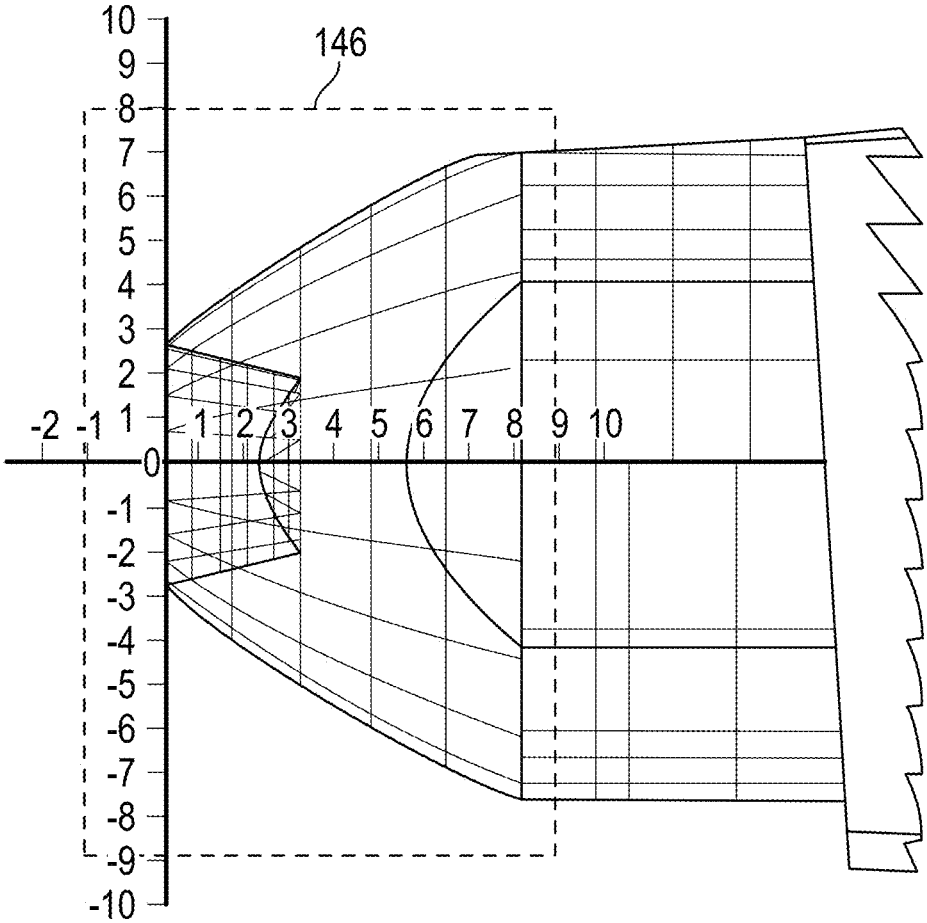
FIG. 4B shows a cross-section of a total internal reflector (TIR) collimator in accordance with one or more embodiments of the disclosure.

FIG. 4B shows a cross-section of a total internal reflector (TIR) collimator 146. The TIR collimator 146 is one potential implementation of the first and second collimators. The TIR collimator 146 is shown to-proportion and may be scaled as needed. A TIR lens/collimator works on the principle of total internal reflection. When light reaches an interface between two materials with different refractive indices and the correct angle of incidence, there is refraction (bending of a light ray from its original path). As light travels from a medium with a higher refractive index to that with a lower one, as per Snell's law, the angle at which the light ray gets refracted is greater than 90 degrees. For angles of incidence exceeding a particular value, the light is reflected into the material of the FIR lens/collimator. The angle for which this occurs is called the critical angle and the phenomenon is called total internal reflection. With a TIR lens/collimator, is minimal loss of power. When the TIR collimator 146 is placed on top of an LED, the TIR collimator 146 captures and directs the photons in the desired direction. Compared with other methods of controlling LED light such as a reflector, the TIR collimator 146 may provide better light control since it captures most of the photons leaving a source. That said, the collimator 120 may instead be a total internal reflector which may have conic sections that are parabolic, spherical, etc. Any shape or combination of lens and reflector that collimates the light from the first lamp 140 may be used.

Figure 5:
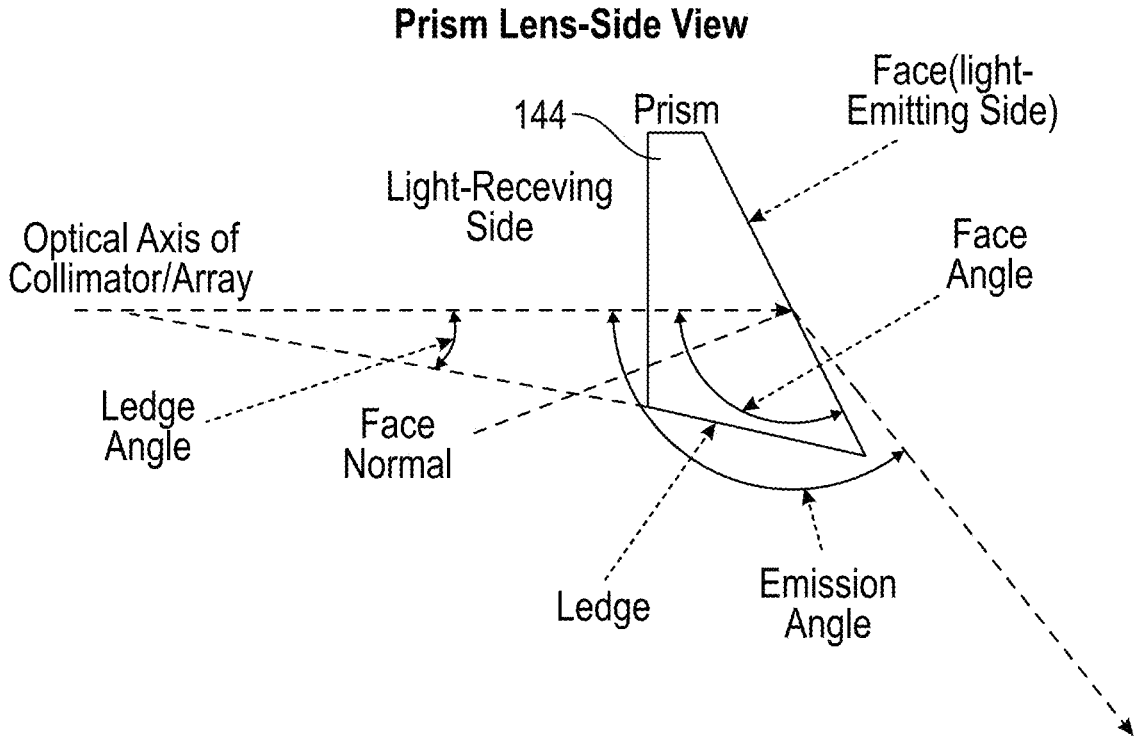
FIG. 5 shows geometric features of a prism lens in accordance with one or more embodiments of the disclosure.

FIG. 5 shows some geometric features of a prism 144 of the prism lens array 130. The prism 144 has a face which has a face angle relative to the optical axis of the second collimator. The prism 144 also has a ledge below the face, and the ledge has a tilt (ledge angle) relative to the optical axis of the second collimator. Light from the direction of the optical axis of the second collimator enters the light-receiving side of the prism 144. The face angle and ledge angle are relevant to light distribution of the prism lens array in several ways. For example, some of the light from the collimator passes through the prism 144 and exits the face, diffracting downward (emission angle) to the ground. Moreover, some of the light from the collimator passes through the prism 144 and is internally reflected downward by the face, exits the ledge (where its direction again changes with diffraction), and is then reflected by the face of the prism (not shown) below the prism 144 shown in FIG. 5. Thus, the face angle of the prism 144 affects uniformity of distribution due to both controlling the angle of emitted-refracted light and due to its reflecting of light emitted from the prism ledge above it. As can be seen, the distribution of light from the prism lens array 130 is a product of (i) individual prisms functioning as individual lenses and (ii) the optical relationships between neighboring prisms.

Figure 6:
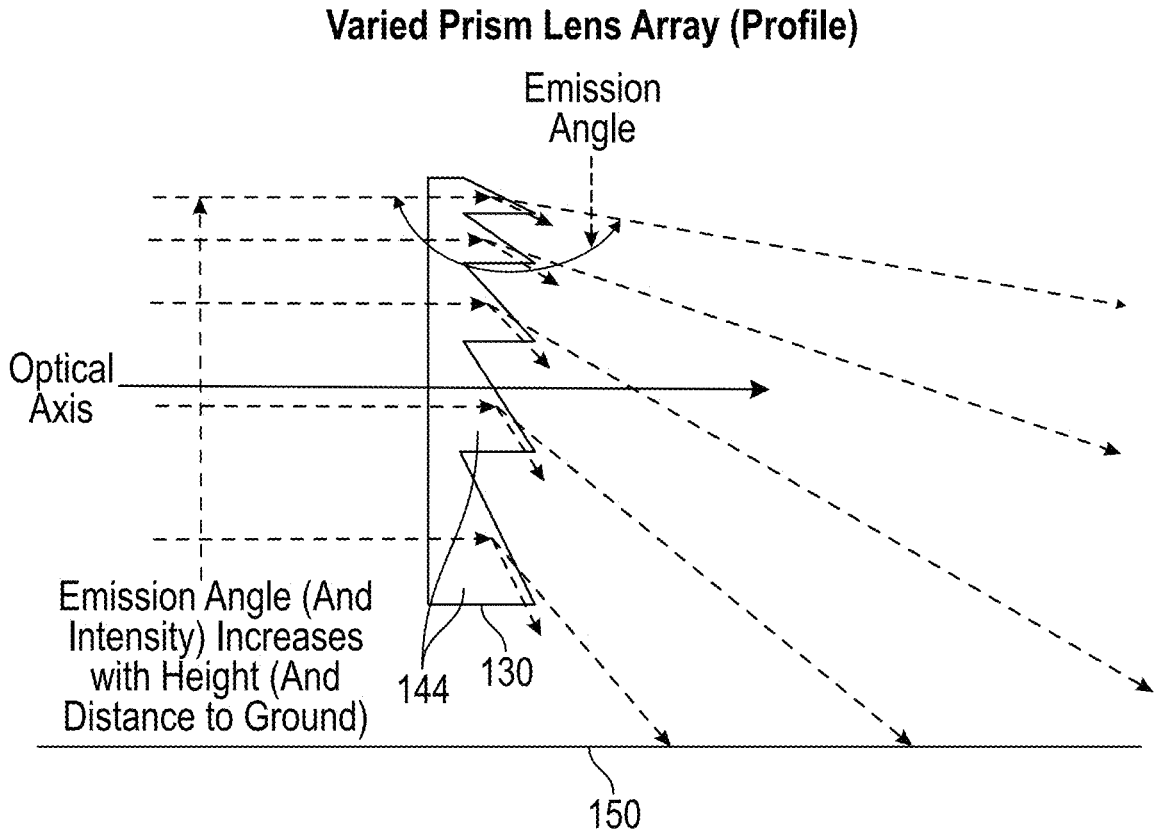
FIG. 6 shows angles and surfaces of the prism lenses in a prism lens array that may vary in accordance with one or more embodiments of the disclosure.

FIG. 6 shows angles and surfaces of the prisms in the prism lens array 130 that may vary. An objective of the prism lens array 130 is to emit light with greater intensity the further the light will fall from the prism lens array 130 (that is, light that falls further from the rear of the vehicle). Light loses intensity in inverse proportion to the square of the distance travelled. Configuring the prism lens array 130 to emit more light at higher (closer to horizontal) emission angles compensates for the loss of intensity that results from the light hitting the ground 150 at greater distance. This can be done by varying the face angles (and hence emission angles) of the prisms, by varying the ledge angles of the prism ledges, and/or by varying lengths of the faces and/or ledges. In one embodiment, the face angles vary as a function of their vertical position. Specifically, the face angles increase as a function of increasing vertical position. The varying of face angles may be non-linear, e.g., may increase in proportion to the squares of their vertical positions. Similarly, ledge angles of the prisms' ledges may vary as a function of their vertical positions. In one embodiment, only face angles vary. In another embodiment, only ledge angles vary. In yet another embodiment both face and ledge angles vary. One way to increase intensity at higher portions of the prism lens array 130 is to shorten the height of the prisms as their heights relative to the ground increases.

Figure 7A:
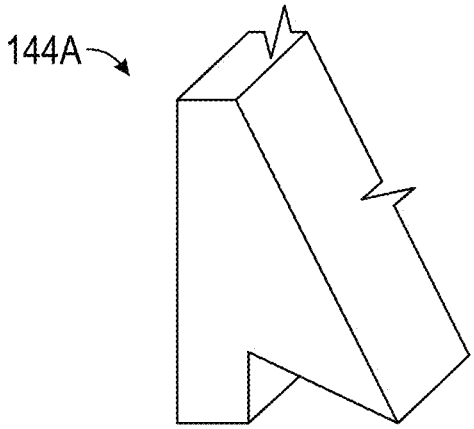
FIGS. 7A-7C shows different profiles of the prisms in the prism lens array in accordance with one or more embodiments of the disclosure.
Figure 7B:
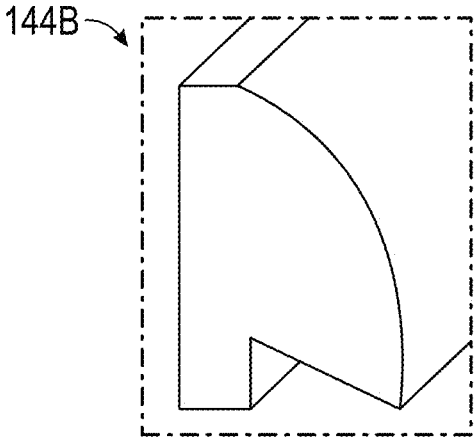
Figure 7C:
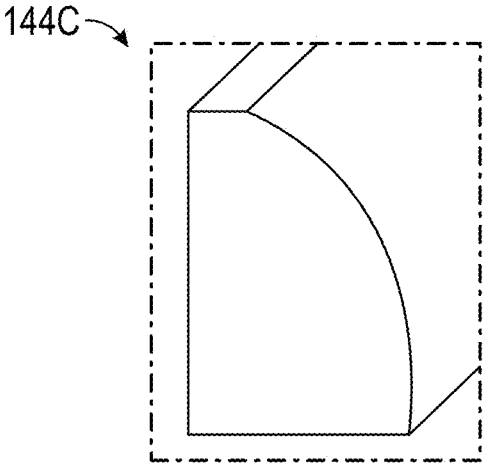
Figure 8:
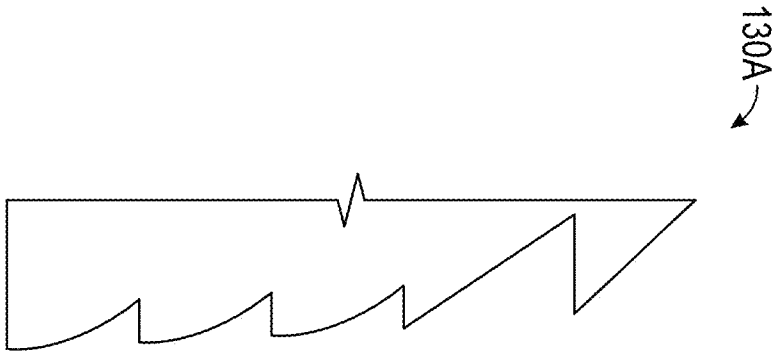
FIG. 8 shows an alternative prism lens array profile in accordance with one or more embodiments of the disclosure.

FIGS. 7A to 7B shows different profiles of the prisms in the prism lens array 130. An angled-ledge prism 144A may be used, as discussed above. Alternatively, an angled-ledge pillow-faced prism 144B may be used. This profile has light-directing properties of prisms discussed above, but with possibly increased diffusion and smoother distribution. More so, it can spread light horizontally to cover the target area close to the vehicle. In addition, a non-angled-ledge pillow-faced profile 144C may be used, which depicts a combined prism and pillow lens. The prism feature (the bottom ledge) of 144C is used to bend light downward close the rear of the vehicle. The pillow feature (the curved right side) of 144C is used to spread light horizontally and vertically. When these two features combine together into one single lens, it can redirect light to the 3×6 m area behind the rear bumper of the vehicle, which is FMVSS 111 rear view camera target area. Other variations are possible to achieve a uniform ground distribution, perhaps taking into account manufacturing constraints. For instance, hybrids of the profiles mentioned above may be used. FIG. 8 shows a prism array profile 130A with both flat-faced and pillow-faced prisms, and with ledge length (prism width) increasing toward the top of the array while prism height decreases. For single pillow lens, if one cuts a section horizontally and vertically, one will get two curvatures, which can be the same or different. When collimated light strikes the pillow lens, light will spread horizontally and vertically. Changing the horizontal or vertical curvatures of the pillow lens, the light spread angle will change, respectively.

Figure 9:
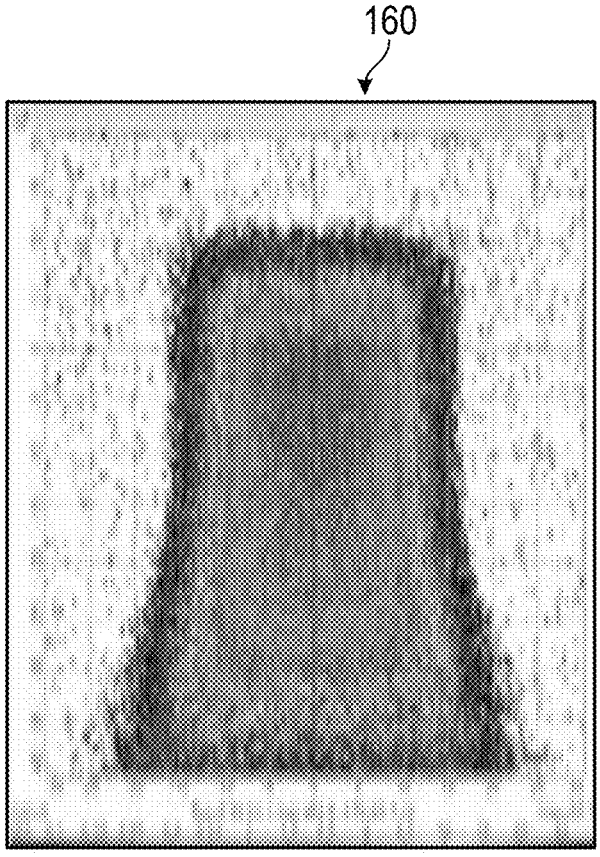
FIG. 9 shows a light intensity distribution pattern of an example implementation of a backup light in accordance with one or more embodiments of the disclosure.

Although there are many possible variations of form for both the pillow lens array and the prism lens array, the combination of the two lens arrays may offer better light distribution than either array alone, may be more efficient than either alone, and may meet a greater number of legal or manufacturer requirements than either alone. FIG. 9 shows a light intensity distribution pattern 160 of an example implementation of a backup light with a pillow lens array and a prism lens array.

As noted above, the first and second optical extensions may be omitted, and the lens arrays may be arranged as covers for their respective collimators. In one embodiment, the lens arrays are formed from a single molded polymer unit. The number of array lights (array-collimator units) of either type may be varied. Embodiments with two prism array lights and one pillow array light might be well-suited to some performance requirements.

In an embodiment where reverse light units are mounted on opposing sides of a vehicle (e.g., above or within ends of a rear bumper), a horizontal spread between the optical axes of the reverse light units of about 3 degrees may be used. With respect to horizontal angling, in one embodiment, there is higher emission intensity at emission angles (see FIG. 6) of around 140 degrees down to about 125 degrees, and decreasing emission intensity from about 125 degrees down to about 112 degrees. Max-to-min contrast ratios of 5:1 may be realized. In one embodiment, the lamps for the respective collimators are 1 watt (~130 lumens). In some instances, the window/opening for the reverse light may act as a lens and/or a clip/mask to control the emission pattern.

Figure 10:
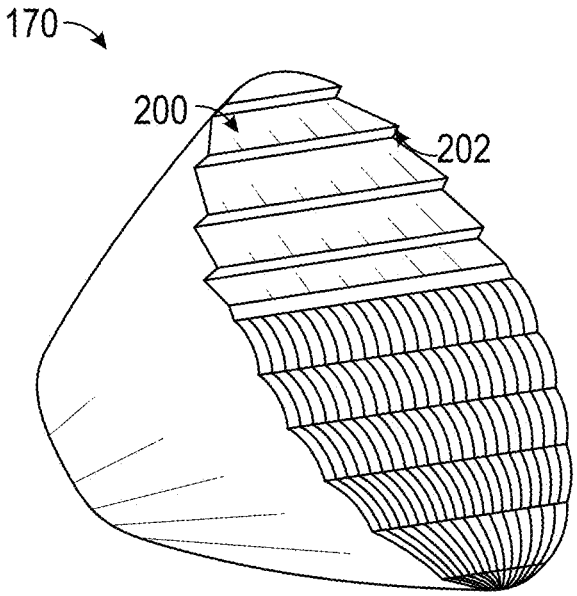
FIG. 10 shows an alternative design that combines a pillow lens array and a prism lens array into a single hybrid lens suppliable by a single collimator in accordance with one or more embodiments of the disclosure.

FIG. 10 shows an alternative design that combines a pillow lens array and a prism lens array into a single hybrid lens 170 suppliable by a single collimator. The individual lenses in the arrays may otherwise be structured as described above. As depicted in FIG. 10, the pillow lens 200 (which is rounded and not flat) is built into the prism lens 202. For example, each lens includes (i) a top part that comprising the pillow lens 200 that spreads light horizontally and (ii) a bottom part comprising the prism lens 202 that bends light downward. It is this combination of the pillow lens 200 and prism lens 202 that enables the lens to achieve the desired results.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," "an example embodiment," etc., indicate that the embodiment described may include a particular feature, structure, or characteristic, but every embodiment may not necessarily include the particular feature, structure, or characteristic. Moreover, such labels or phrases are not necessarily referring to the same embodiment. Further, when a particular feature, structure, or characteristic is described in connection with an embodiment, one skilled in the art will recognize such feature, structure, or characteristic in connection with other embodiments whether or not explicitly described.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described example embodiments but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching. Further, it should be noted that any or all of the aforementioned alternate implementations may be used in any combination desired to form additional hybrid implementations of the present disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

The invention claimed is:

1. A backup optical assembly for a vehicle, the backup optical assembly comprising:

a first optical assembly comprising a first collimator and a pillow lens array, the first collimator optically aligned with the pillow lens array to direct light through the pillow lens array;

a second optical assembly comprising a second collimator and a varying prism lens array, the second collimator optically aligned with the varying prism lens array to direct light through the varying prism lens array, the varying prism lens array comprising prisms comprising respective faces facing away from the second collimator; and faces of respective prisms in at least a subset of the prisms having respective varying face angles relative to an optical axis of the second collimator such that intensities of light provided by the second optical assembly increase in correspondence with increasing distances of the light from the varying prism lens array to the ground.

2. The backup optical assembly according to claim 1, wherein the varying prism lens array is planar and perpendicular to the second collimator, and wherein the varying face angles of the faces in the subset have respective varying angles of emission.

3. The backup optical assembly according to claim 1, wherein the pillow lens array comprises a planar surface facing, and perpendicular to, the first collimator, and wherein the pillow lens array comprises a surface facing away from the first collimator and comprised of columnar pillow lenses.

4. The backup optical assembly according to claim 1, further comprising:

a first optical extension between the first collimator and the pillow lens array, the first optical extension configured to channel light from the first collimator to the pillow lens array, wherein the pillow lens array is planar and perpendicular to an optical axis of the first collimator; and a second optical extension between the second collimator and the varying prism lens array, the second optical extension configured to channel light from the second collimator to the varying prism lens array, wherein the varying prism lens array is planar and perpendicular to the optical axis of the second collimator.

5. The backup optical assembly according to claim 2, wherein a first prism in the subset is above, relative to the ground, a second prism in the subset, and the first prism has a greater angle of emission than the second prism.

6. The backup optical assembly according to claim 4, further comprising:

a first light emitting diode (LED) arranged to supply light to the first collimator; and a second LED arranged to supply light to the second collimator.

7. The backup optical assembly according to claim 6, wherein the backup optical assembly is incorporated in the vehicle, which is configured to supply power to the LEDs based on a signal indicating that the vehicle is backing.

8. A vehicle backup light apparatus comprising:

a pillow lens array;

a first collimator with a first optical axis, the first collimator arranged to direct light to the pillow lens array in a direction of the first optical axis;

a second collimator having a second optical axis, the second collimator and arranged to direct light to a first prism lens array in a direction of the second optical axis;

the first prism lens array comprising prisms, the prisms having respective faces facing opposite the second collimator such that the prisms direct light from the second collimator at varying angles relative to the second optical axis;

a second prism lens array;

a third collimator comprising a third optical axis, the third collimator arranged to provide light to the first prism lens array in a direction of the third optical axis;

wherein the first, second, and third optical axes are parallel; and wherein the pillow lens array, the first prism lens array, and the second prism lens array are coplanar.

9. The vehicle backup light apparatus according to claim 8, wherein:

the first collimator comprises a first total internal reflector that collimates light received by the first collimator; and the second collimator comprises a second total internal reflector that collimates light received by the second collimator.

10. The vehicle backup light apparatus according to claim 8, wherein at least some of the prisms of the first prism lens array comprise faces comprising respective pillow lenses.

11. The vehicle backup light according to claim 8, further comprising a single planar polymer piece comprising the first prism lens array co-planar with the pillow lens array.

12. The vehicle backup light according to claim 8, wherein the prisms of the first prism lens array comprise respective ledges, and wherein the ledges have varying lengths and/or angles relative to the second optical axis.

13. The vehicle backup light according to claim 8, wherein the prisms of the first prism lens array have varying respective heights in a direction perpendicular to the second optical axis.

14. A backup light lens comprising:

a planar pillow lens array comprising a first light-receiving side and a first light-emitting side, the first light-emitting side comprising pillow lenses having respective convex surfaces facing a direction perpendicular to the planar lens array and configured to emit light received by the light-receiving side;

a planar prism lens array comprising a second light-receiving side and a second light-emitting side, the second light-emitting side comprising prisms configured to emit light received by the planar prism lens at varying angles relative to a normal of the second light-receiving side; and wherein the planar pillow lens array and the planar prism lens are co-planar.

15. The backup light lens according to claim 14, wherein the first light-receiving side comprises a first planar surface and wherein the second light-receiving side comprises a second planar surface.

16. The backup light lens according to claim 14, wherein the prisms comprise linear prisms arranged parallel with respect to each other.

17. The backup light lens according to claim 15, wherein the first planar surface and the second planar surface are co-planar.

18. The backup light lens according to claim 16, wherein the linear prisms comprise respective faces that join respective ledges, wherein the linear prisms have respective heights, and wherein (i) the heights vary relative to each other, (ii) lengths or angles of the ledges vary relative to each other, and/or (ii) lengths or angles of the faces vary relative to each other.

19. The backup light lens according to claim 17, further comprising:

a first lamp;

a first total internal reflector collimator arranged to collimate light from the first lamp to the pillow lens array;

a second lamp; and a second total internal reflector collimator arranged to collimate light from the second lamp to the prism lens array.

* * * * *